United States Patent [19]

Beery

[11] 4,385,756

[45] May 31, 1983

[54] SHEET INVERTING AND STACKING APPARATUS

[75] Inventor: Jack Beery, Fairport, N.Y.

[73] Assignee: Xerox Corporation, Stamford, Conn.

[21] Appl. No.: 182,340

[22] Filed: Aug. 29, 1980

[51] Int. Cl.[3] ..... B65H 29/40

[52] U.S. Cl. ..... 271/186; 271/187; 271/315

[58] Field of Search ..... 271/187, 186, 315, 314, 271/65, DIG. 9, 178, 176, 83; 414/81; 198/403

[56] References Cited

U.S. PATENT DOCUMENTS

| | | | |
|---|---|---|---|
| 3,512,771 | 5/1970 | Dempsey et al. | 271/187 X |
| 3,847,384 | 11/1974 | Bethke | 271/187 X |
| 3,904,192 | 9/1975 | Pfeifer et al. | 271/186 |
| 3,968,960 | 7/1976 | Fedor et al. | 271/187 |
| 4,052,053 | 10/1977 | Hasegawa et al. | 271/187 |
| 4,060,231 | 11/1977 | Stobb et al. | 271/187 X |
| 4,088,314 | 5/1978 | Phillips | 271/176 |
| 4,120,491 | 10/1978 | Lang | 271/187 X |
| 4,275,874 | 6/1981 | DiBlasio | 271/187 X |

OTHER PUBLICATIONS

Monday, J. L. "Tined Stacker Wheel," *IBM Technical Disclosure Bulletin*, vol. 18, No. 7, Dec. 1975, pp. 2273–2274.

*Primary Examiner*—Bruce H. Stoner, Jr.

[57] ABSTRACT

Sheet inverting and stacking apparatus includes a rotatable inverter wheel having at least one arcuate sheet retaining slot into which a sheet may be inserted, the slot being sufficiently large in length that a substantial portion of the sheet may be inserted in the slot without the leading edge of the sheet contacting the end of the slot, a driver to incrementally rotate the wheel from a sheet load position to a sheet unload position, a driver to drive a sheet into the slot at the load position, the distance between the sheet driver and the end of the slot in the wheel being greater than the length of a sheet to be fed and a sheet stripper registration member at the unload position to strip a sheet from within the slot and register its leading edge. In a specific embodiment, the inverter comprises a fixed member having a generally cylindrical surface from the load position to the unload position and two parallel arcuate arms of larger diameter having parallel slots therein for transporting sheets from the load to the unload position and wherein the parallel arms are brought to a stop at both the load and unload positions.

13 Claims, 5 Drawing Figures

SHEET INVERTING AND STACKING APPARATUS

REFERENCE TO COPENDING APPLICATION

Reference is hereby made to copending application Ser. No. 182,343, entitled Sheet Offsetting and Registering Apparatus filed concurrently herewith in the name of Jack Beery and Werner F. Hoppner.

BACKGROUND OF THE INVENTION

This invention relates to sheet inverting and stacking apparatus and in particular to the inverting and stacking of sheets produced from automatically reproducing machines. More specifically it relates to a simple device which serves to transport copies produced from an automatic reproducing machine to an output station and collect them in a collated and registered fashion.

In many automatic copying machines the geometry of the machine elements is such that with the paper path the copies produced have the image on the top side. Thus sequential copies enter the collecting tray with the copy or image side up. This is satisfactory if only a single copy of a single image is desired or if multiple copies of a single image is desired. In both cases, no distinction between sequential copies is required and all copies may be readily collected with the image side up. It is also satisfactory if the original documents fed to the copying machine are fed in reverse order, last or bottom sheet first and first or top sheet last. In this instance the collected set has the top sheet face up on top and the bottom sheet face up on the bottom of the set. However, in most instances of copying sets of documents, the set is face up with top sheet on the top and if copied according to normal procedures, the top sheet number one is copied, producing a copy face up and a set so produced has sheet number one face up on the bottom and the last sheet face up on the top. It can therefore be seen that it is desired to obtain the copies in the same order as the original set so that in the set produced by the copying machine the last sheet is on the bottom of the set and the top sheet is on the top of the set, both being face up. In addition, in electronic printing it is also advantageous to be able to print from the first page to the last page in order since if you print from the last sheet to the first sheet the substance of the first to last pages must be stored in the printers memory thereby increasing the size and cost of the memory required.

This result may be accomplished in copying a set of sheets if the top sheet, number one sheet, is fed first to be copied and the copy produced which is image side up is inverted such that the image is on the bottom side. With copying of successive sheets of a set and inverting each copy the final set is collected face down with the top sheet on the bottom and the bottom sheet on the top.

PRIOR ART

A number of techniques have been used in the past for inverting sheets. Exemplary of the prior inverting devices are those that have long belt drives which drive the sheet up in a first direction and then back the sheet in an opposite direction using the original trailing edge as the leading edge.

U.S. Pat. No. 3,968,960 to Fedor et al describes a sheet inverting and stacking apparatus wherein the leading edge of a sheet is sensed at a particular location, the rotary inverter is actuated with a leading edge deflecting element engaging the leading edge to decelerate it and deflect it from its path to a stacking platform. The trailing portion of the sheet is conveyed by two belt conveyors at about its original velocity and moves past the leading edge as the leading edge is deflected around an arc by the rotary inverter so that the sheet eventually is rolled over and deposited in an inverted position on the stacking tray or preceding sheet. With the difference in speed between the leading and trailing edges the lead edge engaging element is able to deflect the leading edge of a sheet downward as the belts urge the remaining portion of the sheet past the leading edge to cause inversion of the sheet.

With the difference in speed, the leading edge moving slower than the trailing edge, the lead edge is constantly driven against the deflecting element thereby increasing the probability of damage to the leading edge. While lead edge damage may not be a serious problem for heavyweight papers it can be a serious problem for the lighter weight papers in that the edges may be curled, bent or crushed thereby producing untidy and even misregistered sheets in a stack or set of sheets all of which lead to user disatisfaction.

Furthermore, since both the lead edge and trailing edge of the sheet are placed under stress in this type of apparatus there is the possibility of additional damage particularly for light weight paper, due to buckling, tearing and jamming.

It is also known to use continuously rotating wheels or drums which have sots, envelopes or other chambers on the periphery in which the leading edge of a sheet may be inserted as the wheel disc or drum is rotated and the sheet is advanced into engagement with a slot opening. All these devices suffer the disadvantage that as the wheel moves, the sheet must catch up to the slot in the wheel before it is physically captured thereby increasing the probability of error in alignment of the sheet and even the possibility that the leading edge of the sheet will not be captured in the slot leading to a possible jamming of the sheet in the machine. Furthermore, with the sheet overtaking the slot the design typically allows the sheet to fully enter the slot such that the leading edge of the sheet impacts the front of the slot.

SUMMARY OF THE INVENTION

In accordance with the present invention an improved sheet inverting and stacking apparatus is produced. In particular this apparatus has a rotatable sheet inverter wheel having at least one arcuate sheet retaining slot into which a sheet may be inserted, the slot being sufficiently long in length that a substantial portion of the sheet may be inserted in the slot without the leading edge of the sheet contacting the end of the slot. The wheel is incrementally rotated from a sheet loading position to a sheet unloading position coming to rest at each position. At the sheet loading position a sheet drive drives a sheet into the slot, the distance between the sheet drive and the end of the slot in the wheel being greater than the length of a sheet to be fed. The wheel is rotated and at the sheet unloading position a sheet stripper registering member strips the sheet from within the slot in the wheel and registers the leading edge. In this configuration the lead edge of a sheet to be inverted is not contacted by any surface, nor is the lead edge jammed against a stop surface. Furthermore since a substantial portion of the sheet is held within the slot, the possibility of damage to it is substantially reduced.

In a preferred embodiment the inverter wheel comprises a fixed member having a generally cylindrical surface from the load position to the unload position and two parallel arcuate arms of larger diameter having parallel slots therein for transporting sheets from the load to the unload position the slots being sufficiently long in length that a major portion of the sheet may be inserted in the slot. To achieve this result the wheel is brought to a stop at both the load and unload positions.

Accordingly, it is an object of the present invention to provide a novel sheet inverting and stacking apparatus.

It is an additional object of the invention to provide a novel reproducing apparatus with a copy inverter and stacker.

It is an additional object of the present invention to provide a simple, reliable, compact sheet inverting and stacking apparatus.

It is a further object of the present invention to provide a sheet inverting and stacking apparatus which permits a sheet to be inserted in a stationary inverter without damaging the leading edge of the sheet.

It is a further object of the present invention to provide a sheet inverting and stacking apparatus where at least a substantial portion of the length of the sheet is fed into a stationary inverter.

It is a further object of the present invention to provide a sheet inverting and stacking apparatus which automatically inverts and stacks sheets as they are delivered to it.

It is an additional object of the invention to provide a device which simultaneously inverts sheets, stacks them in a receiving tray and registers their leading edge.

It is an additional object of the present invention to provide a sheet inverting and stacking apparatus which automatically registers and stacks sets of sheets.

It is a further object of the present invention to provide a sheet inverting and stacking apparatus where at least a majority of the length of the sheet is fed into a stationary inverter.

For a better understanding of the invention as well as other objects and further features thereof reference is had to the following drawings and description.

DESCRIPTION OF PREFERRED EMBODIMENT

Figure 1:
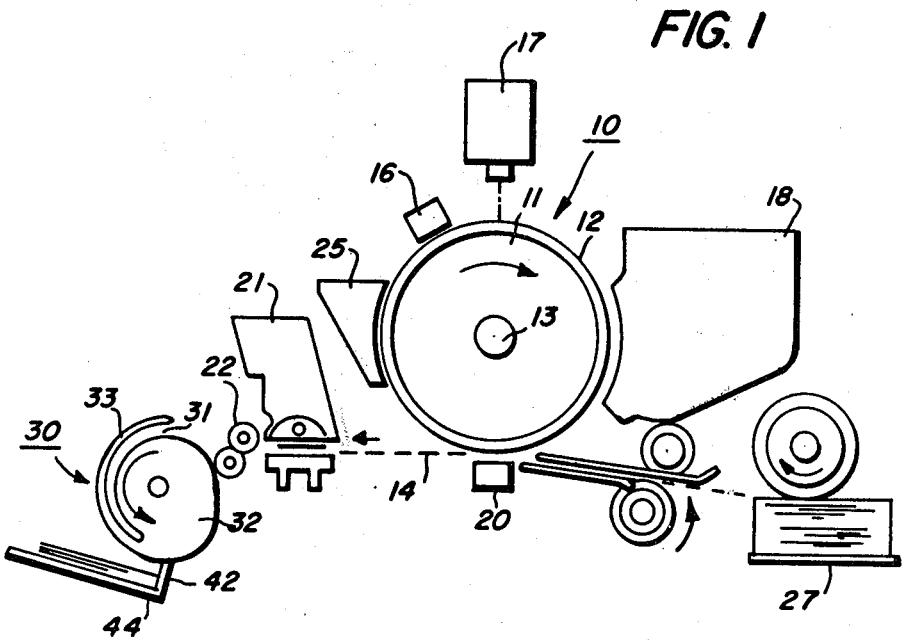
FIG. 1 is a schematic representation in cross-section of an automatic xerographic reproducing apparatus employing the sheet inverter and stacker of the present invention.

Referring now to FIG. 1, there is shown by way of example an automatic xerographic reproducing machine 10 which incorporates the sheet inverter and stacker of the present invention. The reproducing machine 10 depicted in FIG. 1 illustrates the various components utilized therein for producing copies from an original. Although the sheet inverter and stacker of the present invention is particularly well adapted for use in an automatic xerographic reproducing machine 10, it should become evident from the following description that it is equally well suited for use in a wide variety of machines where it is desired to invert and stack processed sheets. It is not necessarily limited in its application to the particular embodiment shown herein.

The reproducing machine 10 illustrated in FIG. 1 employs an image recording drum-like member 11 the outer periphery of which is coated with a suitable photoconductive material 12. The drum 11 is suitably journaled for rotation within a machine frame (not shown) by means of a shaft 13 and rotates in the direction indicated by the arrow to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet 14 of final support material. Initially, the drum 11 moves photoconductive surface 12 through charging station 16 where an electrostatic charge is placed uniformly over the photoconductive surface 12 of the drum 11 preparatory to imaging. The charging may be provided by a corona generating device.

Thereafter, the drum 11 is rotated to exposure station 17 where the charged photoconductive surface 12 is exposed to a light image of the original input scene information, whereby the charge is selectively dissipated in the light exposed regions to record the original input scene in the form of a latent electrostatic image.

The optical system may be a conventional scanning or stationary optics or may be an electronically controlled and actuated laser source which successively strikes the photoconductive surface as a raster scan.

After exposure, drum 11 rotates the electrostatic latent image recorded on the photoconductive surface 12 to development station 18 where a conventional developer mix is applied to the photoconductive surface 12 rendering the latent image visible. Typically a magnetic brush development system utilizing a magnetizable developer mix having carrier granules and a toner colorant is used. The developer mix is continuously brought through a directional flux field to form a brush thereof. The electrostatic latent image recorded on photoconductive surface 12 is developed by bringing the brush of developer mix into contact therewith.

The developed image on the photoconductive surface 12 is then brought into contact with a sheet 14 of final support material within a transfer station 20 and the toner image is transferred from the photoconductive surface 12 to the contacting side of the final support sheet 14. The final support material may be paper, plastic, etc., as desired. After the toner image has been transferred to the sheet of final support material 14, the sheet with the image thereon is advanced to a suitable radiant fuser 21, which coalesces the transferred powdered image thereto. After the fusing process, the sheet 14 is advanced by fuser output rolls 22 to the inverter and stacker 30 of the present invention.

Although a preponderance of toner powder is transferred to the final support material 14, invariably some residual toner remains on the photoconductive surface 12 after the transfer of the toner powder image to the final support material 14. The residual toner particles remaining on the photoconductive surface 12 after the transfer operation are removed therefrom as it moves through cleaning station 25. Here the residual toner particles are first brought under the influence of a cleaning corona generating device (not shown) adapted to neutralize the electrostatic charge remaining on the toner particles. The neutralized toner particles are then mechanically cleaned from the photoconductive surface 12 by conventional means as, for example, the use of a resiliently biased knife blade.

If desired the sheets 14 of final support material processed in the automatic xerographic reproducing machine 10 can be stored in the machine within a removable paper cassette 27.

It is believed that the foregoing description is sufficient for purposes of the present application to illustrate the general operation of the automatic xerographic reproducing machine 10 which can embody the features of the present invention.

Figure 2:
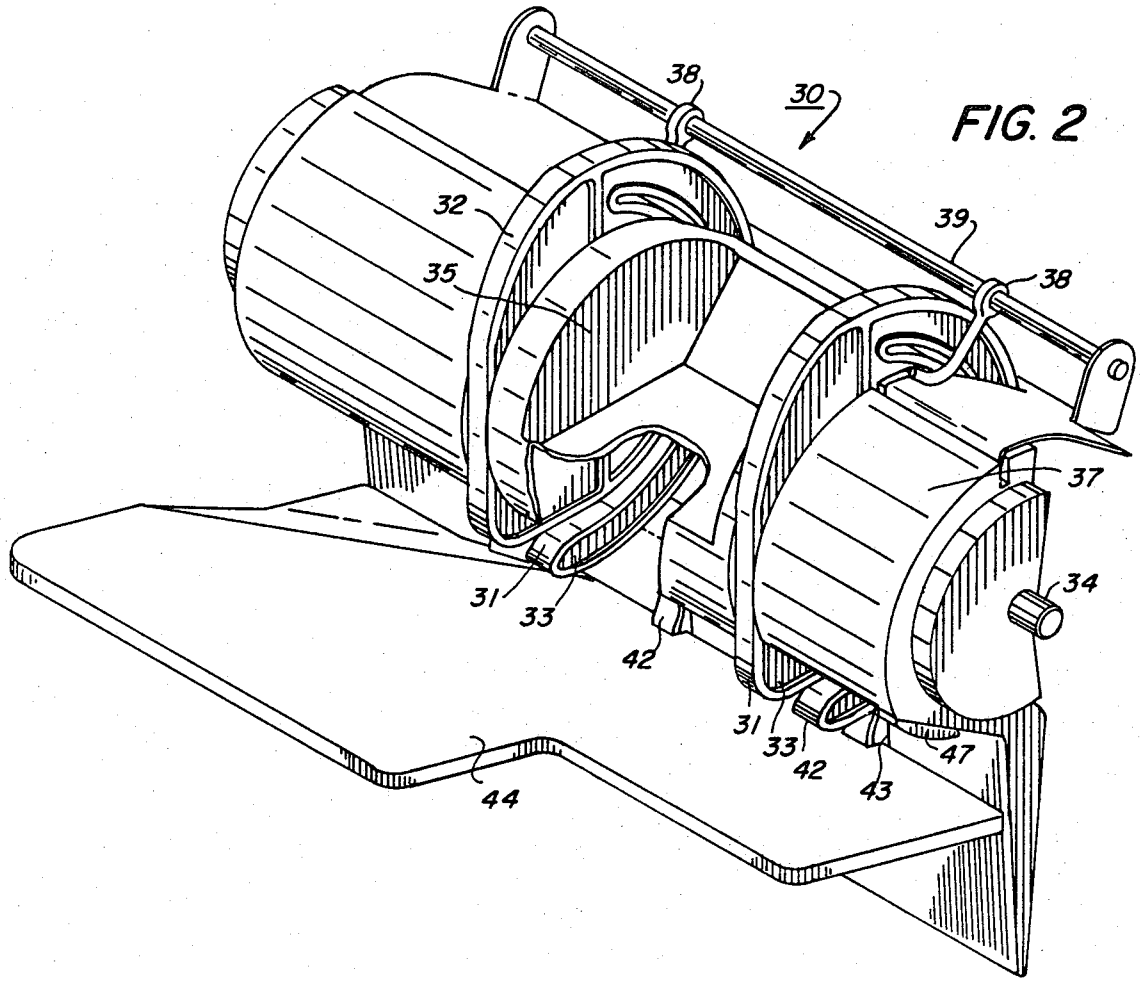
FIG. 2 is an isometric view from the right front of the sheet inverter and stacker of the present invention.

With continued reference to FIG. 1 and additional reference to FIG. 2 the inverter stacker 30 is placed at the output station of the fuser output rolls 22 such that the rolls drive a sheet to be inverted into the slot 31. When the sheet has left the output fuser rolls and is inside the slot 31 the inverter wheel 32 is rotated counterclockwise about 180° and the stripping registration members 42 strip the sheet from the slot 31 in the wheel 33 finally depositing the sheet in tray 44 as the wheel continues to turn.

The inverter stacker 30 comprises an interior stationary drum or hub 37 which is generally circular in configuration from the inverter wheel load position to the unload position and rounded from the sheet unload to load position. The drum 37 has a hand indent 35 in the center to facilitate manual sheet removal should the need arise if jamming of a sheet occurs. A drive shaft 34 which is driven by means not shown drives two parallel arcuate arms 33 having parallel arcuate sheet retaining slots 31 therein so that a sheet may be transported in the slots from the sheet load to the sheet unload position. Sheet guides 38 mounted on shaft 39 assist in guiding a sheet into the retaining slots 31. After insertion of the sheet as the wheels are turned and the sheet moves from the load to the unload position, the trailing portion is maintained in position against the hub 37 by sheet guides 38. When the parallel arms turn counterclockwise the sheet is retained within the slots 31. However as the arms turn through the bottom portion of the arc they pass through apertures 43 in the stationary hub 37. When the lead edge of the sheet in the slot 31 approaches the unloading position the vertical stripping registration members 42 which are interposed between and on the outsides of the arms 33 strip the sheet from the slot into the sheet collecting tray 44. As the sheet is stripped from the slot 31 registration of the leading edge of the sheet is achieved as the sheets abut against the members 42. Registration is also maintained as the arm rotates completely out of position, each sheet having its leading edge registered in the tray. This is readily facilitated because as each sheet is stripped from the slot 31 it drops into the tray free of friction between adjacent sheets because the velocity of the sheet being stripped is zero relative to the previous sheet in the tray.

Figure 3A:
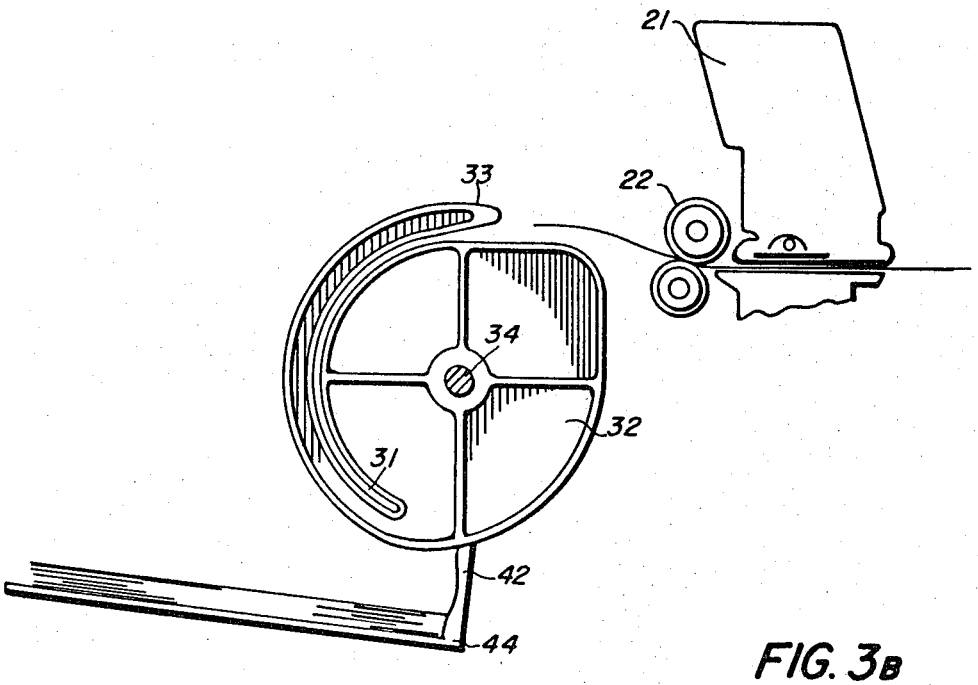
FIGS. 3A, 3B and 3C are enlarged schematic representation in cross-section showing the location of a sheet and the inverter stacker at three separate points in the operational cycle.
Figure 3B:
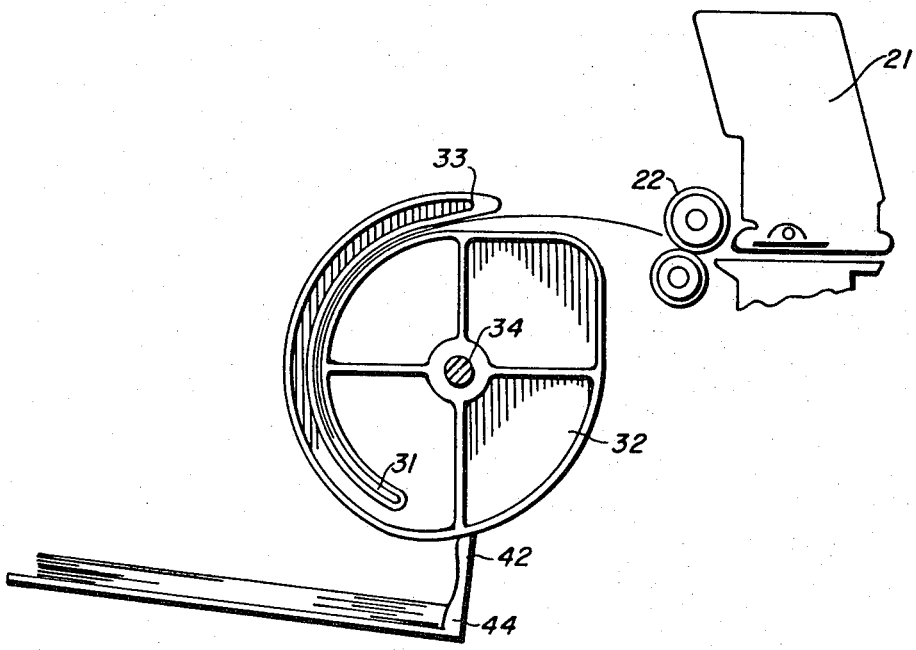
Figure 3C:
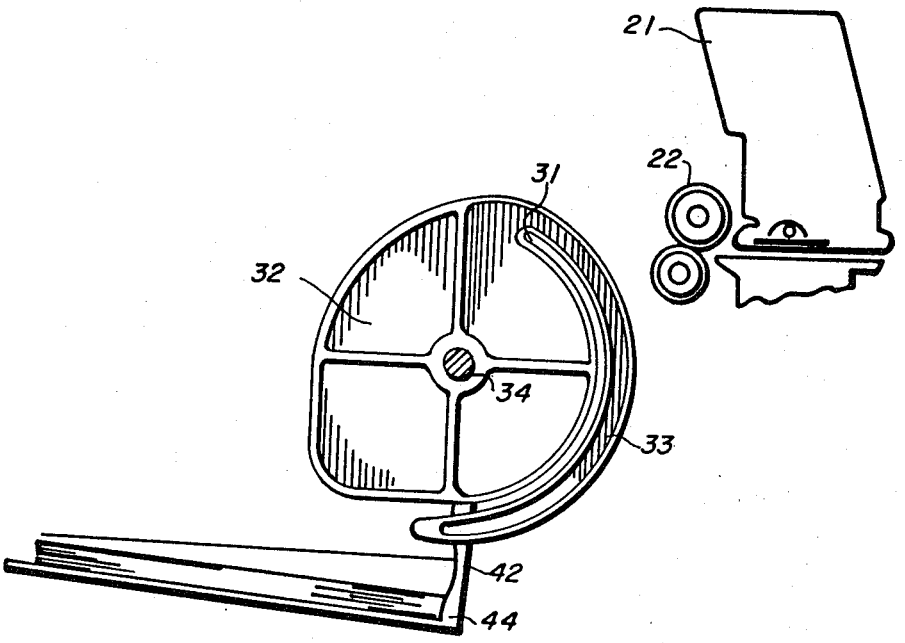

With additional reference to FIGS. 3A, 3B, and 3C the operation will be further described. The inverter wheel 32 is driven from the unload or shut down position as a sensor (not shown) senses a sheet exiting the output fuser rolls 22. The inverter wheel reaches the load position with the slots 31 in arms 33 ready to accept the lead edge of the sheet being driven by the fuser output rolls 22. The fuser output rolls 22 continue to drive the sheet into the slot 31 until the sheet is clear of the rolls. The distance between the fuser output rolls and the end of the slot 31 is longer than the length of any sheet likely to be fed to the inverter. In this way the lead edge of the sheet does not come in contact with the slot end and is not driven against any hard surface thereby minimizing the opportunity for damaging the leading edge of the sheet. The inverter assembly is placed sufficiently close to the fuser output rolls and the slot 31 is sufficiently long that a substantial portion of the sheet at least is inserted in the slots 31. This portion should be sufficient to maintain physical control over the sheet when it travels from the load to the unload position. In ensuring control over the sheet preferably a majority of the sheet is inserted in the slots. This permits a greater percentage of the sheet to be touched by the sides of the slot and by friction with the slot surfaces transported while in the slots to the unload position. During sheet insertion the inverter wheel 30 is stationary to facilitate predictable sheet insertion on each cycle.

Once the trailing edge of the sheet has cleared the output fuser rolls 22 the inverter wheel 32 is rotated counterclockwise to the unload position and carries with it the sheet to be inverted. At the output station the lead edge of the sheet in the slots comes into contact with the stripping registration members 42 which inhibit further travel of the sheet. Thus as the movement of the sheet is stripped the inverter wheel continues to rotate until the arms 33 have cleared the sheet stripping zone. As each sheet is sheared off the arcuate slots one at a time by the stripping members 42 and when the trailing edge of the arms 33 has cleared the leading edge of the sheet the sheet floats down into the sheet stacking tray. When the trailing edges of the arms of the inverter wheel have cleared the stripping registration members, it stops at the unload position to wait for the next inverting cycle. With the inverter arms at the bottom of the cycle in the unload position the inverter is readily cleared of any jamming of sheets.

With specific references to FIGS. 3A, 3B and 3C, FIG. 3A shows the leading edge of the sheet entering the slot 31 while being driven by the fuser output rolls 22. FIG. 3B depicts the sheet positioned in the slot after sheet insertion when the sheet has exited the output fuser rolls. During this operation the inverter has remained stationary while the sheet has gently slid down the slot without the leading edge being abutted against the slot end. As may also be observed, the majority of the sheet is captured within the slot 31. FIG. 3C shows the trailing edge of the arm 33 clear of the sheet stripping and registration members 42 as the sheet is about to gently fall while being registered against the stripping and registration member with the tray 44.

The above described inverting and stacking device has the advantage of simplicity in design and operation as well as maintaining a great degree of predictable control over the operation while minimizing the opportunity for damage to the sheet, particularly the leading edge. It has the additional advantage in that it simultaneously inverts the sheet while registering the leading edge of successive sheets. Furthermore by stopping the inverter wheel in the load position there is no relationship between the inverter speed and the sheet input speed and thus the inverter speed may be considered independent of the process speed.

While this invention has been described with reference to the specific embodiments described, it will be apparent to those skilled in the art that many alternatives, modifications or variations may be made by those skilled in the art. For example, while the invention has been described with reference to two parallel arms having a single inverting slot therein, the device will work equally well with three or four parallel arms each of which may have more than one slot forming a plurality of parallel inverting slots. It is intended to embrace all such alternatives and modifications as may fall within the spirit and scope of the appended claims.

I claim:

1. A sheet inverting and stacking apparatus comprising;

a sheet inverter wheel including at least one arcuate sheet retaining slot into which a sheet may be inserted, said slot being sufficiently long in arcuate length to accommodate at least a substantial portion of the length of a sheet to be inverted without the leading edge of the sheet contacting the end of the slot, said inverter wheel comprising a fixed member having a continuous generally cylindrical surface from a load position to an unload position, said cylindrical surface having a hand indent between the load and unload position to facilitate manual sheet removal, means to incrementally rotate said sheet inverter wheel from said sheet load position to said sheet unload position, sheet drive means to drive a sheet in a forward direction into said slot when said inverter wheel is in the load position; the distance between the sheet drive means and the end of the slot in the inverter wheel when in the load position being greater than the length of a sheet to be fed whereby the leading edge of the sheet does not contact the end of said slot, a sheet stripper registration member at the unload position to strip a sheet from within the slot and register its leading edge.

2. The sheet inverting and stacking apparatus of claim 1 wherein said inverter wheel comprises two larger parallel rotatable arcuate arms having parallel arcuate slots therein for transporting sheets from said load to said unload position whereby said sheets may be held in said slots above the fixed cylindrical surface.

3. The sheet inverting and stacking apparatus of claim 2 wherein said sheet stripper registration member comprises fixed vertical stop members interposed between the path of said rotatable arcuate arms.

4. The sheet inverting and stacking apparatus of claim 2 wherein said cylindrical surface has apertures in the path from the unload to load position through which the arcuate arms may rotate.

5. The sheet inverting and stacking apparatus of claim 1 wherein said means to incrementally rotate said sheet inverter wheel brings said wheel to a stop at both the load and unload positions.

6. The sheet inverting and stacking apparatus of claim 1 wherein said means to incrementally rotate said sheet inverter wheel is independent of said sheet drive means.

7. The sheet inverter and stacking apparatus of claim 1 wherein said inverter wheel is in the load position when the slot opening is at the top and is in the unload position when the slot opening is at the bottom of the path through which the wheel is rotated.

8. The sheet inverting and stacking apparatus of claim 1 including a stacking tray adjacent the unload position for stacking sheets as they are stripped from the slot in the inverter wheel.

9. The sheet inverting and stacking apparatus of claim 1 wherein said sheet drive means comprises a pair of driven pinch rolls at the output end of a fuser in an automatic copying machine.

10. The sheet inverting and stacking apparatus of claim 1 wherein said slot is sufficiently long in arcuate length to accommodate at least a major portion of the length of a sheet to be inverted and stacked.

11. The sheet inverting and stacking apparatus of claim 1 wherein said slot has an arcuate length longer than the size of a sheet to be inverted and stacked.

12. The sheet inverting and stacking apparatus of claim 1 wherein said sheet unload position is substantially opposite said sheet load position on said inverter wheel.

13. The sheet inverting and stacking apparatus of claim 12 wherein said sheet unload position is substantially diametrically opposite said sheet load position on said inverter wheel.

* * * * *